United States Patent [19]

Farino

[11] Patent Number: 5,037,348

[45] Date of Patent: Aug. 6, 1991

[54] THERAPEUTIC BRASSIERE FOR BREASTS HAVING IMPLANTS

[75] Inventor: Frank G. Farino, Shaker Heights, Ohio

[73] Assignee: Leading Lady, Inc., Beachwood, Ohio

[21] Appl. No.: 562,240

[22] Filed: Aug. 3, 1990

[51] Int. Cl.[5] ..... A41C 3/02; A41C 3/06

[52] U.S. Cl. ..... 450/1; 450/60; 450/70; 450/76; 450/79; 450/80; 450/82; 2/73

[58] Field of Search ..... 2/73, 109, 163, 170, 2/DIG. 6; 128/157; 450/1, 13, 18, 23, 40, 50, 57, 58, 59, 60, 70, 76, 79, 80, 82, 83, 85, 86, 87, 88

[56] References Cited

U.S. PATENT DOCUMENTS

| | | | |
|---|---|---|---|
| 1,062,858 | 5/1913 | Smith | 2/109 |
| 2,239,056 | 4/1941 | Schiffer | 450/59 X |
| 2,363,017 | 11/1944 | Plehn | 450/86 |
| 2,424,453 | 7/1947 | Glick | 450/1 |
| 2,454,152 | 11/1948 | Glick | 450/79 X |
| 2,579,546 | 12/1951 | Cadous | 450/83 X |
| 2,586,267 | 2/1952 | Schaumer | 450/70 |
| 2,662,522 | 12/1953 | Muller | 128/155 |
| 2,717,437 | 9/1955 | De Mestral | 28/72 |
| 2,760,199 | 8/1956 | Champagne | 450/58 X |
| 2,782,418 | 2/1957 | Garson | 450/88 X |
| 3,040,750 | 6/1962 | Harwitz | 450/88 X |
| 3,062,216 | 11/1962 | Stein | 128/467 |
| 3,256,886 | 6/1966 | Sachs | 450/59 |
| 3,298,366 | 1/1967 | Moore et al. | 128/157 |
| 3,411,510 | 11/1968 | Child | 450/70 |
| 3,548,833 | 12/1970 | Lavergne | 450/70 X |
| 3,561,442 | 2/1971 | Goswitz | 128/157 |
| 3,665,929 | 5/1972 | Brantly | 450/70 |
| 3,698,399 | 10/1972 | Hand | 450/59 |
| 3,746,007 | 7/1973 | Hand et al. | 450/86 X |
| 3,779,250 | 12/1973 | Radomski | 450/70 X |
| 3,968,803 | 7/1976 | Hyman | 128/482 |
| 4,143,662 | 3/1979 | Fisher | 450/86 X |
| 4,767,377 | 8/1988 | Falla | 450/76 X |
| 4,957,466 | 9/1990 | Hopps | 450/23 X |

FOREIGN PATENT DOCUMENTS

| | | | |
|---|---|---|---|
| 1086901 | 10/1980 | Canada | 450/1 |
| 156518 | 10/1985 | European Pat. Off. | 450/1 |
| 75415 | 8/1949 | Norway | 450/60 |
| 365258 | 1/1932 | United Kingdom | 450/61 |
| 597485 | 2/1948 | United Kingdom . | |
| 714271 | 8/1954 | United Kingdom | 450/40 |

*Primary Examiner*—Werner H. Schroeder
*Assistant Examiner*—Jeanette E. Chapman
*Attorney, Agent, or Firm*—Body, Vickers & Daniels

[57] ABSTRACT

A therepeutic brassiere for supporting breast implants includes breast receiving cups. Each of the cups is formed from a section of body engaging fabric joined together at a common seam. A chest encircling band is joined to the lower marginal edges of the cups for affixing the brassiere to the chest of a wearer. An elastic strip of material, attached to both the upper marginal edges of the cups and to the chest encircling band prevents movement or distortion of the breast implants.

13 Claims, 4 Drawing Sheets

THERAPEUTIC BRASSIERE FOR BREASTS HAVING IMPLANTS

The present invention relates to the art of brassieres and more particularly to a therapeutic brassiere having a support for preventing movement or distortion of a breast implant.

The present invention is particularly applicable for use in a therapeutic brassiere worn by a post-operative patient who has recently had implants surgically inserted in one or more of her breasts and will be described with particular reference thereto; however, the invention has much broader applications and may be used in various other brassieres for persons requiring pressure to be exerted against the upper surface of the breasts to prevent movement thereof.

Related Applications

This application is related to U.S. Application Ser. No. 562,241, filed Aug. 3, 1990 entitled A THERAPEUTIC CHEST DRESSING FOR BREASTS HAVING IMPLANTS by Mark Corrado, filed concurrently herewith and having a common assignee.

BACKGROUND OF THE INVENTION

After a surgical operation wherein an implant is inserted in one or both breasts of a patient, there is a tendency for the implant to move or shift to an unwanted position or even distort its shape during the initial healing period which typically lasts at least about one week. To overcome this tendency, it has been a common practice to bind the breasts with an elastic bandage which encircles the chest of the post-operative patient and exerts pressure on the upper surface of the breasts and presses them towards the wearers chest. However, changing the bandage was a relative complex procedure which could not be easily accomplished by the patient or an untrained person. Also, the force with which the bandage was applied to the breast had to be carefully controlled which was somewhat difficult to manage due to the size of the chest encircling bandage.

THE INVENTION

The present invention relates to a chest encircling structure which for use by a post-operative patient to prevent movement or distortion of an implant in one or more breasts. In accordance with the present invention, there is provided a therapeutic brassiere having breast receiving cups formed of fabric which is joined together at a common seam across the cups. A chest encircling band is joined to the lower marginal edge of the cups for fixing the brassiere to the chest of the wearer. A support strip of material is attached to the upper marginal edge of the cups and to the chest encircling band for exerting a force against the top surface of the breast to press them downwards towards the lower chest and thereby prevent an implant within a breast from distorting or shifting to an unwanted position.

The invention also includes a connector strip which extends between the support strip and the chest encircling band to ensure that the support strip maintains a relatively constant pressure against the upper surface of the breast. The cups of the brassiere are preferably made of a non-irritating material, such as cotton. However, the cups can be formed from a stretchable material which stretches in all directions to conform with the natural shape of the breast and, if necessary, the dressing on the patient's closed incision. The term "stretchable" is distinguished from elastic in that a stretchable material conforms to the body shape without exerting substantial pressure.

It is an aspect of the present invention that the support strip and connector strip be made of a non-elastic, non-stretchable fabric in order that the amount of force applied is substantially constant. Therefore, both the support strip and the connector strip are preferably formed of two layers of material. The inner layer which contacts the body of the person is preferably formed of a relatively non-irradiating material, such as cotton, while the layer of material which does not contact the wearer's body and is closer to the cup can be made of a foam-like material backed with fabric.

The chest encircling band has free ends and is constructed of an elastic material. An elastic material has a pronounced return capability so that when elongated, a returning force is exerted which returning force is quite high and proportional to the amount of elongation. The free ends overlap each other at engaging surfaces when the therapeutic brassiere is placed on a person using same. A two element, contact sensitive, reusable fastening means for releasably securing the free ends together in selected, adjustable longitudinal positions is provided for closing the brassiere around the wearer. One element of the fastening means is secured onto each of the engaging surfaces of the free ends of the body encircling band.

In accordance with the preferred embodiment of the present invention, the contact sensitive, reusable fastening means are "Velcro" fasteners which are disclosed in U.S. Pat. No. 2,717,437. This patent is incorporated by reference herein and includes a disclosure of a fastening means including a gripping strip having a number of small, outwardly extending, closely spaced, flexible hooks. The hooks engage the strands of a loosely knitted, velvet type fabric by a transverse engagement of the strip having the hooks with the velvet-like fabric. This type of fastening means is well known and involves no metal elements. In addition, the fastening means is infinitely variable in that the gripping strip including the hooks can be positioned at various locations on the fabric strip to adjust the position of the two flaps of the strips with respect to each other. The stretchable fabric in combination with the Velcro fasteners enables a patient to put on the brassiere of the present invention by themselves with relative ease.

The primary object of the present invention is to provide a therapeutic brassiere which prevents implants recently put into breasts through surgery from distorting or moving or shifting to an undesirable position.

A further object of the present invention is to provide a therapeutic brassiere for breasts having newly, surgically inserted implants which exerts pressure on the upper surface of the breasts to prevent the imparts from moving, shifting or distorting.

A still further object of the present invention is to provide a therapeutic brassiere for breasts having newly, surgically inserted implants which is relatively easy to fasten into place.

It is a still further object of the present invention to provide a therapeutic brassiere for breasts having newly, surgically inserted implants which is relatively inexpensive to manufacture.

These and other objects and advantages will become apparent from the following description.

PREFERRED EMBODIMENT

Figure 1:
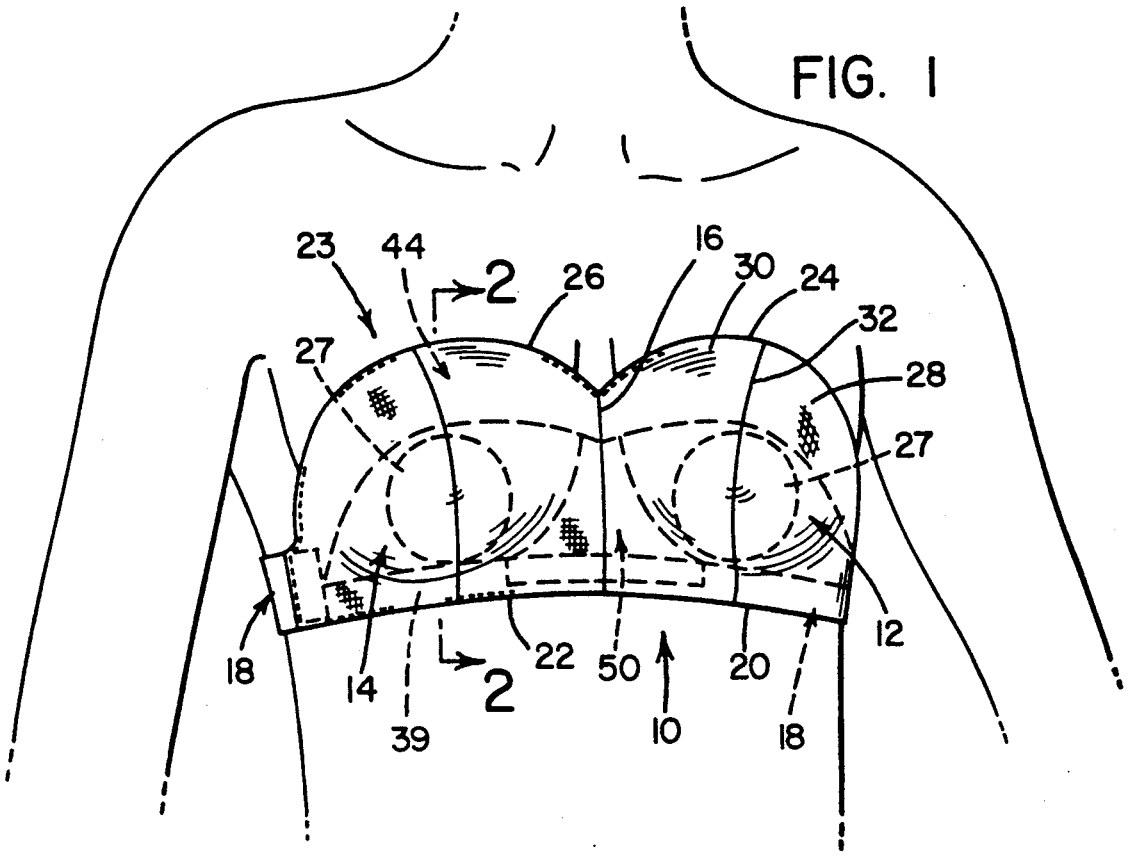
FIG. 1 is a front view of a person wearing a therapeutic brassiere for breasts having implants constructed in accordance with the present invention.
Figure 2:
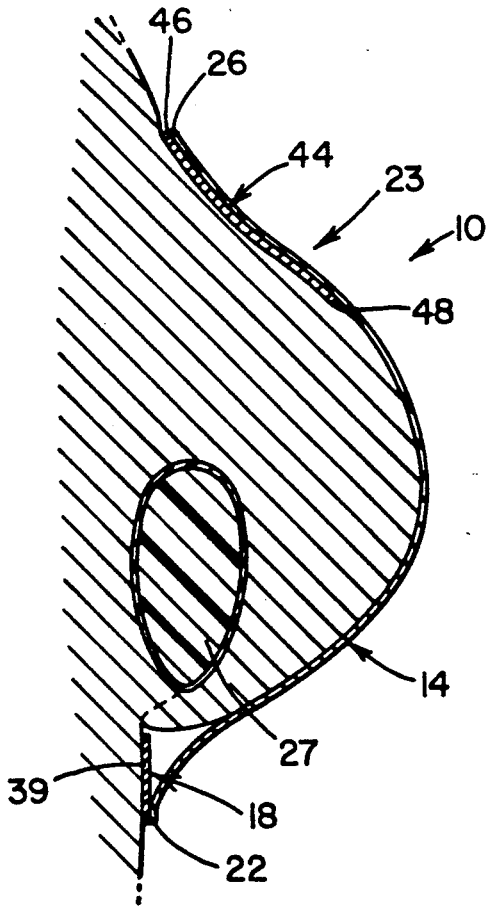
FIG. 2 is an enlarged cross sectional view taken generally along the line 2—2 in FIG. 1.
Figure 3:
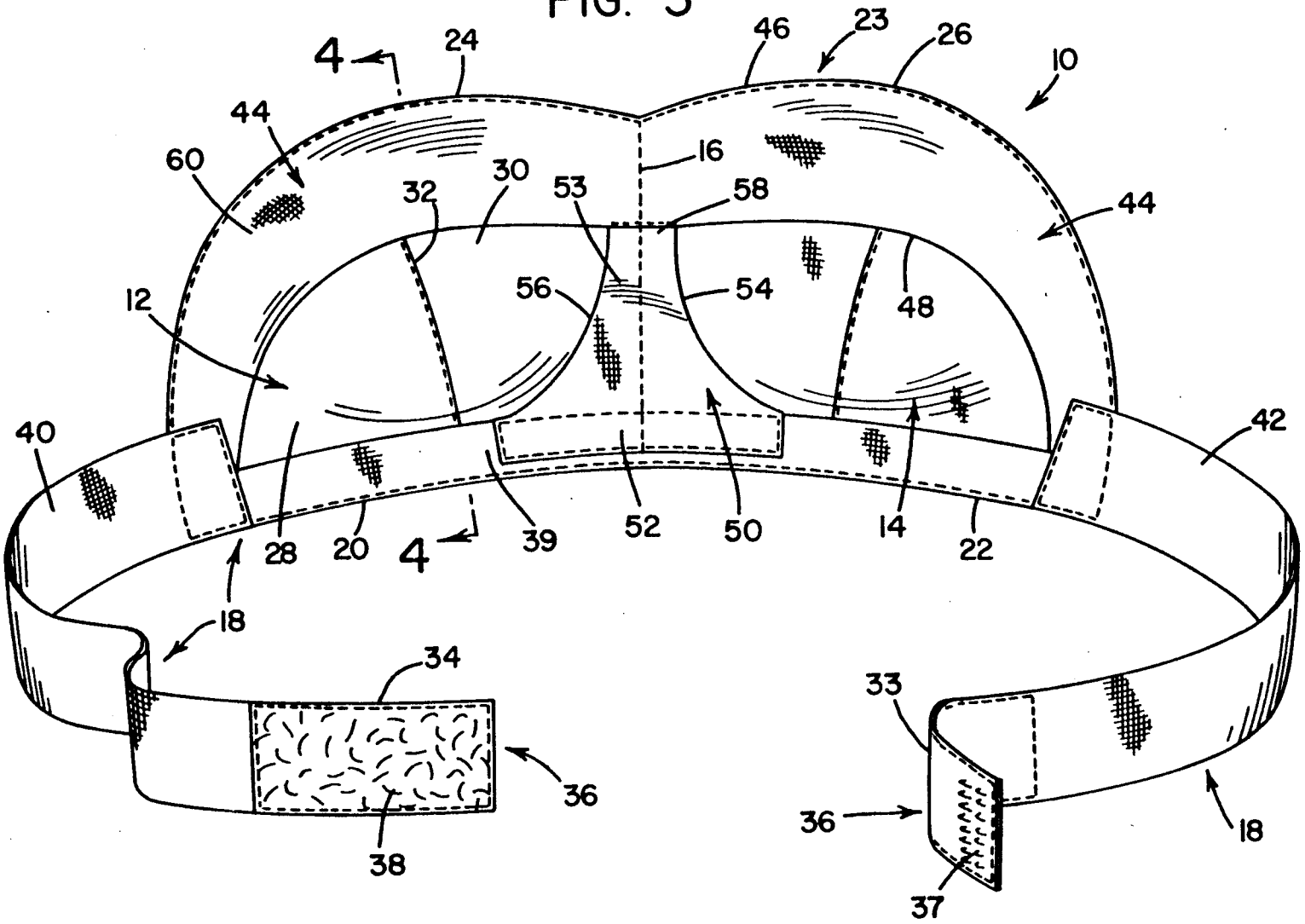
FIG. 3 is a rear view of a therapeutic brassiere for breasts having implants in accordance with the present invention.

Referring now to the drawings wherein the showings are for the purpose of illustrating a preferred embodiment of the invention only and not for the purpose of limiting same, FIGS. 1 and 3 taken together show a therapeutic brassiere 10 for supporting breast implants. The brassiere 10 includes breast receiving cups 12 and 14. Each of the cups is formed from a section of body engaging fabric joined together at a common seam 16 extending generally across the cups 12 and 14. A chest encircling band means 18 is joined to the lower marginal edges 20 and 22 of cups 12 and 14 for affixing the brassiere to the chest of a wearer. Means 23 are attached to both the upper marginal edges 24 and 26 of the cups 12 and 14, respectively, and to the chest encircling band means 18 for preventing movement or distortion of the implants 26 in a breast received in one or more of the cups.

Referring specifically to the construction of the therapeutic brassiere 10, the two cups 12 and 14 are spaced from each other and sewn together along a common seam 16. It is also within the terms of the present invention to form each of the cups of several sections of material. For example, cup 12 can be constructed of two sections of material 28 and 30 which are joined together by a common seam 32. However, it is within the terms of the invention to construct the cups in any desired manner with any number of segments incorporating any desired stitching. Typically, both cups 12 and 14 will be constructed in substantially the same manner. Since the material forming the cups is typically in contact with the body of the wearer, it is preferably constructed of a soft, non-irritating material such as, for example, cotton. However, the cups can also be formed primarily from a stretchable, but non-elastic fabric or material. This definition is well known in the art and in practice is a loose weave, porous 100% knit Nylon which allows freedom of movement of the material in all directions and a low recovery force so that the material does not exert substantial pressure on the person during use of the brassiere.

The chest encircling band means 18 is preferably constructed of a longitudinally continuous, stretchable, elastic fabric. The band means 18 further includes a continuous band 39 of elastic fabric which extends the length of the connected cups 12 and 14 and is attached to the lower marginal edges 20 and 22 so as to lie against the chest of the patient using the brassiere. The continuous front portion is adjoined at either side to elastic spaced band ends 40 and 42 which are typically wider than the band 39 and are attached to the lower, outer marginal edge of cups 12 and 14, respectively. The band ends 40 and 42 are preferably wider than the band 39 so as to distribute the pressure on the back and sides of the wearer's body and thereby substantially prevent discomfort to the wearer of the brassiere of the present invention. The band ends 40 and 42 are provided with free ends 32 and 34. The free ends overlap each other when the brassiere is in place around a post-operative patient. The overlapping surfaces of these ends are provided with a two element, contact sensitive, reusable fastening means 36 to provide infinitely selected longitudinal positions within a given general range determined by the elements forming the fastening means 36. Means 36 preferably include no metal elements and is, in the preferred embodiment, a Velcro fastener wherein the first element 37 is a transversely extending gripping strip including a number of small, outwardly extending, closely spaced flexible hooks which take on the appearance of a rough fabric. The second element 38 is a fabric strip extending transversely of flexible band 18 and interlocks with the hooks of gripping strip 37. The second element assumes the normal appearance of a velvet fabric. It is however, within the terms of the present invention to use any other conventional fastener, including metal elements, as desired.

The means 23 for preventing movement or distortion of an implant in a breast includes a support strip 44 of substantially non-stretchable, non-elastic fabric to provide longitudinal stability to the brassiere. The strip 44 is affixed to the sides of each of the cups which contacts the body of the wearer. The strip 44 is of a substantial width extending from the upper marginal edges 24 and 26 towards the lower marginal edges 20 and 22 of cups 12 and 14, respectively. Further, the strip 44 is contoured so that its upper marginal edge 46 follows the contour of the upper marginal edges of cups 12 and 14 and extends from the common seam 16 to the lower marginal edges 20 and 22. The lower marginal edge 48 o the strip is in spaced relationship to the upper marginal edge and generally follows the contour of the upper marginal edge 46. The width of the strip 44 is substantial in order that the pressure exerted against the top surface of the breasts will be adequately distributed in order to prevent discomfort to the wearer. Preferably, the strip 44 is stitched along its upper edge to the upper marginal edges 24 and 26 of the cups 12 and 14, respectively. The lower edge 48 of the strip is not stitched to the cups in order to allow the cups 12 and 14 to conform to the shape of the breasts of the wearer. Also, the support strip 44 is stitched from edge 46 to edge 48 along the common seam 16.

Figure 6:
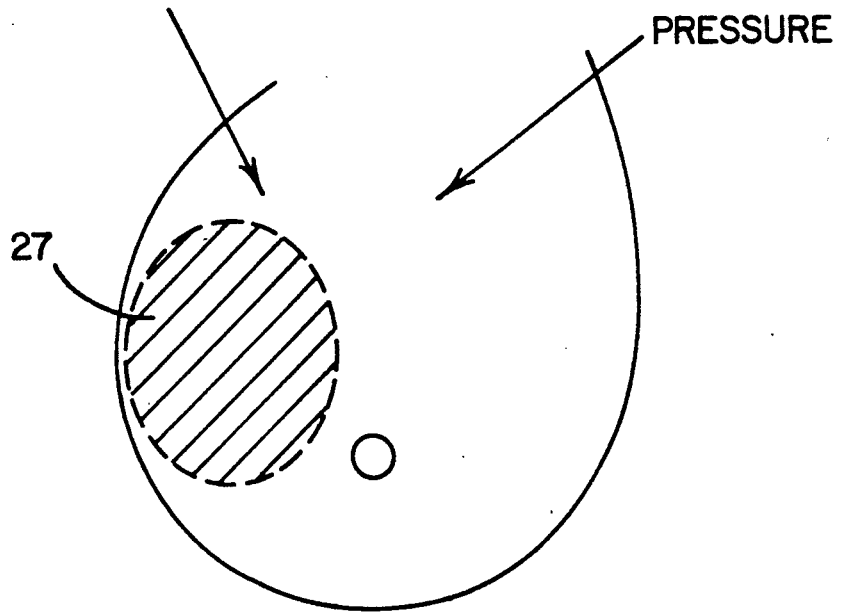
FIG. 6 is a front view showing the force exerted by the therapeutic brassiere of the present invention on a breast having an implant in a first position; and, FIG. 7 is a view illustrating the force of the therapeutic brassiere of the present invention on a breast having an implant in a second position.
Figure 7:
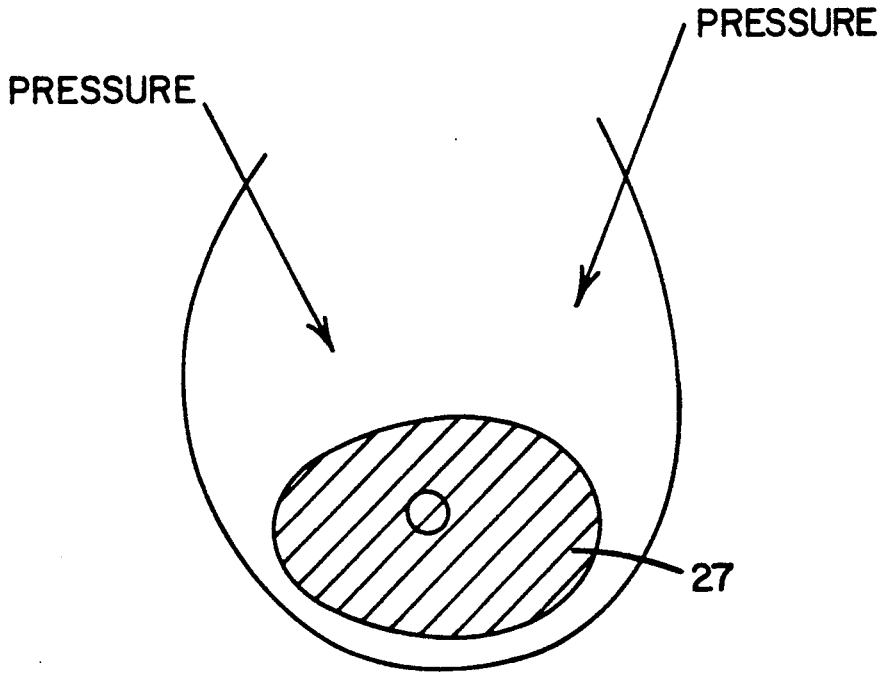

The movement or distortion preventing means 23 further includes a connector strip 50 of non-stretchable, non-elastic fabric extending between the support strip 44 and the chest encircling band means 18. The connector strip 50 is to provide transverse stability for the support strip 46. The connector strip includes a lower end section 52 which is preferably stitched to the band 39. Extending above the lower end section 52 is a narrowed upstanding section 53 having opposing concave surfaces 54 and 56 which decrease the width of the upstanding section in the direction of the upper end 58. The narrowed width enables the connector strip to be positioned between the patient's breasts and comfortably contacting the surface of the chest. The upper end 58 of the connector strip 50 is preferably stitched to the lower edge 48 of the support strip 44. In addition, the connector strip 50 is stitched to the common seam 16 through the cups 1Z and 14. As mentioned, the connector strip 50 is disposed to contact the chest of the wearer. The connector strip 50 further provides transverse stability to maintain the pressure of the support strip 44 to effectively flatten the breasts against the wearers chest and exert pressure as shown in FIGS. 6 and 7 to prevent the implant 17 from distorting or shifting position during the period of healing.

Figure 4:
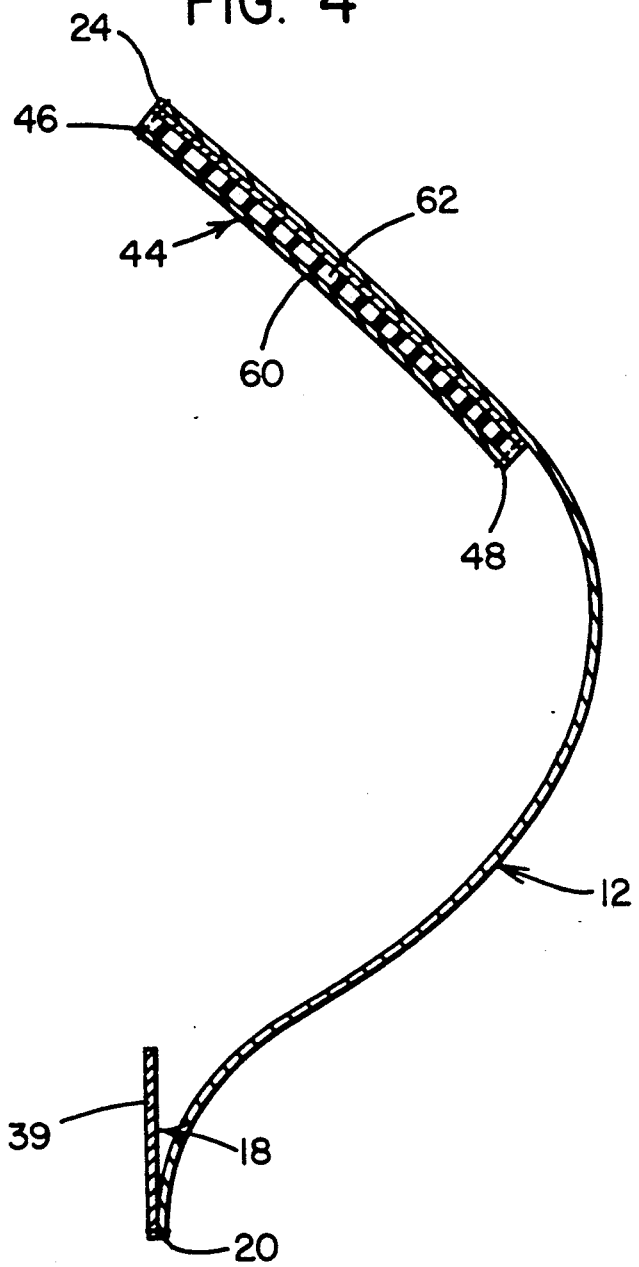
FIG. 4 is a further enlarged cross sectional view taken generally along the line 4—4 in FIG. 3.
Figure 5:
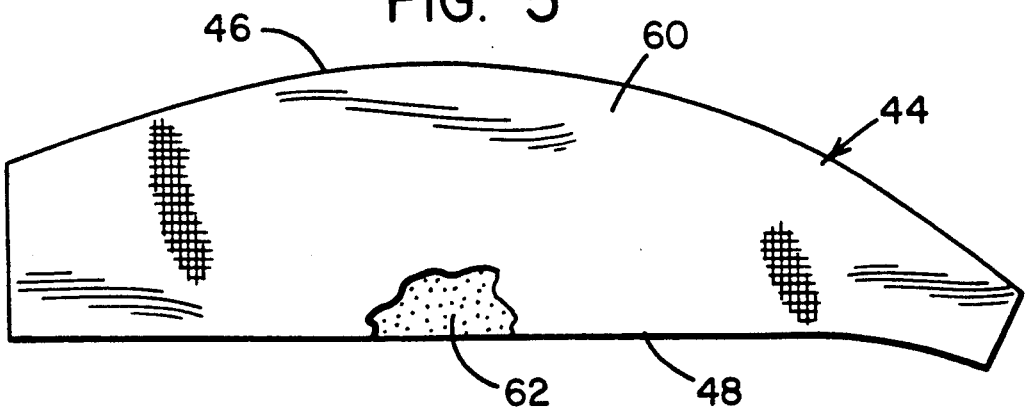
FIG. 5 is a partial view, partially cut away of the support strip of fabric of the therapeutic brassiere of the present invention.

Both the non-stretchable, non-elastic support strip 44 and connector strip 50 are preferably formed of material constructed of first and second segments 60 and 62, as illustrated in FIGS. 4 and 5. The first segment 60 of the material is preferably constructed of a relatively soft material, such as cotton, since it is most likely in direct contact with the patient's skin. It is also within the terms of the present invention to form the cups of a stretchable but non-elastic fabric which allows for freedom of movement of the material in all directions and provides a low recovery force so that the material does not exert substantial pressure on the person wearing the brassiere. Accordingly, soft material is selected to substantially prevent any discomfort or irritation to the patient's skin. The second segment 62 of the material, which is disposed between the first segment 60 and the cups 12 and 14, is preferably constructed of a foam-like backed material to cushion and distribute the pressure over the top surface of the breast.

The invention has been described with reference to a preferred embodiment and it is apparent that many modifications may be incorporated into the design and configuration of the therapeutic brassiere for breasts having implants without departing from the spirit or the essence of the invention. It is my intention to include all such modifications and alterations insofar as they come within the scope of my invention. It is thus the essence of my invention to provide a therapeutic brassiere which can be readily adapted and configured to be incorporated in a wide variety of applications.

Wherefore it is claimed:

1. A therapeutic brassiere for breasts having implants, comprising:

breast receiving cups joined together along a common seam, each of said cups being formed from a section of body engaging fabric, said cups generally having upper and lower marginal edges;

chest encircling band means joined to the lower marginal edges of the cups only for affixing the brassiere to the body of a wearer; and, means attached to the upper marginal edges of the cups and to the chest encircling band means for pressing the breasts within the cup downward against the body of the wearer so as to prevent movement or distortion of the implant in each breast received in one or more of said cups.

2. The therapeutic brassiere of claim 1 wherein the means attached to the upper edges of the cups comprises a support strip having an upper marginal edge affixed to the upper marginal edges of the cups and a lower marginal edge in spaced relationship to the upper marginal edge of the strip being unattached to the cups except at the marginal edges of the cups to allow the cups to conform to the shape of the wearer's breast.

3. The therapeutic brassiere of claim 2 wherein the support strip is affixed to the common seam between the upper and lower marginal edges of the support strip.

4. The therapeutic brassiere of claim 3 wherein the means for preventing movement or distortion further includes a connector strip of fabric extending between the support strip and the chest encircling band means, said connector strip being affixed to the common seam between the lower marginal edge of the support strip and the chest encircling band means.

5. The therapeutic brassiere of claim 4 wherein said support strip is constructed of a substantially non-stretchable fabric.

6. The therapeutic brassiere of claim 5 wherein said connector strip is constructed of a substantially non-stretchable fabric.

7. The therapeutic brassiere of claim 6 wherein said support strip and said connector strip are formed of fabric constructed of first and second segments of material sewn together.

8. The therapeutic brassiere of claim 7 wherein said support strip and said connector strip are affixed to a side of the section of fabric forming the cups, said side of the section contacting the body of the wearer.

9. A therapeutic brassier for breasts having implants, comprising:

breast receiving cups joined together along a common seam, each of said cups being formed from a section of body engaging fabric, said cups generally having upper and lower marginal edges;

chest encircling band means joined to the lower marginal edges of the cups for affixing the brassiere to the body of a wearer;

means attached to the cups and to the chest encircling band means for preventing movement or distortion of the implant in each breast received in one or more of said cups;

the means for preventing movement or distortion being attached to the upper marginal edge of the cups;

the means attached to the upper edges of the cups comprising a support strip having an upper marginal edge affixed to the upper marginal edges of the cups and a lower marginal edge in spaced relationship to the upper marginal edge of the strip being unattached to the cups except at the marginal edges of the cups to allow the cups to conform to the shape of the wearer's breast, the support strip being affixed to the common seam between the upper and lower marginal edges of the support strip, said support strip constructed of a substantially non-stretchable fabric;

the means for preventing movement or distortion further including a connector strip of fabric extending between the support strip and the chest encircling band means, said connector strip being affixed to the common seam between the lower marginal edge of the support strip and the chest encircling band means, said connector strip being constructed of a substantially non-stretchable fabric;

said support strip and said connector strip being formed of fabric constructed of first and second segments of material sewn together, said support strip and said connector strip further being affixed to a side of the section of fabric forming the cups which contacts the body of the wearer; and said first segment of material, which is for contacting the body of the wearer is constructed of a soft material, and said second segment of material, which is disposed between the first segment of material and the cups is constructed of a foam-like backed material.

10. The therapeutic brassiere of claim 9 wherein said body encircling band means comprises a band having free ends, said band being constructed of an elastic fabric.

11. The therapeutic brassiere of claim 10 including means for fastening the free ends of the band together.

12. The therapeutic brassiere of claim 11 wherein the means for fastening includes a two element, contact sensitive, reusable fastening means for releasably securing said free ends together in selected, adjustable longitudinal positions with one element of said fastening means being secured to the other element.

13. The therapeutic brassiere of claim 12 wherein one of said elements of said contact sensitive, reusable fastening means is a gripping strip including a number of small, outwardly extending, closely spaced flexible hooks and said other of said elements is a fabric strip into which said hooks are releasably engaged by contact of said gripping strip with said fabric strip.

* * * * *